US006393233B1

(12) United States Patent
Soulier

(10) Patent No.: US 6,393,233 B1
(45) Date of Patent: May 21, 2002

(54) PRINTER FUSER POWER MANAGEMENT

(75) Inventor: George R. Soulier, Weiser, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/695,776

(22) Filed: Oct. 24, 2000

(51) Int. Cl.[7] ..... G03G 15/00
(52) U.S. Cl. ..... 399/88; 219/216; 399/67
(58) Field of Search ..... 399/33, 37, 67, 399/69, 70, 88; 219/216, 490, 492, 494, 497

(56) References Cited

U.S. PATENT DOCUMENTS 5,670,832 A * 9/1997 Takeda ..... 399/37 X
6,072,585 A 6/2000 Dutton et al. ..... 358/1.12
6,114,669 A * 9/2000 Van Mil et al. ..... 219/497

* cited by examiner

*Primary Examiner*—Sophia S. Chen
*Assistant Examiner*—Hoan Tran
(74) *Attorney, Agent, or Firm*—Leslie G. Murray

(57) ABSTRACT

An electrophotographic imaging device having a controller including power management circuitry managing the distribution of electrical power to an image fixing device and other electrically powered components. The power management circuitry manages the power distribution first to provide the image fixing device with sufficient power to meet the image fixing requirements, and second to meet the power requirements of the remaining electrically powered components. For example, during normal operation of the imaging device, if, for a particular print job, more heat is required to fix the toner with sufficient strength thus requiring a higher image fixing device temperature to maintain the same printer speed (pages per minute) additional electrical power is required for the image fixing device. In response, the power management circuitry will direct additional power to the image fixing device first from surplus available power, and, second, from power made available by selectively redirecting power from other imaging device components. The electrical power to various components is selectively reduced to ensure that sufficient power is available to meet the requirements of the image fixing device.

14 Claims, 2 Drawing Sheets

PRINTER FUSER POWER MANAGEMENT

FIELD OF THE INVENTION

The present invention relates generally to electrophotographic imaging devices, and, more particularly, to providing power management for optimum fuser performance.

BACKGROUND OF THE INVENTION

Electrophotographic marking is a well-known, commonly used method of copying or printing documents. Generally, the electrophotographic process includes charging a photoconductive member to a substantially uniform potential so as to sensitize the surface thereof. A charged portion of the photoconductive surface is exposed at an exposure station to a light image presentation of a document to be printed or reproduced. That light image discharges the photoconductor, creating an electrostatic latent image of the desired document on the photoconductor's surface. Toner particles are then deposited on to that latent image, forming a toner image. The toner image is subsequently transferred from the photoconductor onto a substrate, such as a sheet of paper or other print medium. The transferred toner image is then fused to the substrate, usually using heat and/or pressure, thereby creating a permanent image so as to form a "hard-copy" of the desired document. The surface of the photoconductor is then cleaned of residual developing material and recharged in preparation for the production of another image.

When fusing toner onto a substrate it is beneficial to heat the toner to a point where the toner coalesces and becomes tacky. The heat causes the toner to flow into the fibers or pores of the substrate. Adding pressure increases the toner flow. Then as the toner cools it becomes permanently attached to the substrate. To produce the heat and pressure for fusing, most fusers include a heated element and a pressure-inducing element that act together to form a nip. When a toner bearing substrate passes through that nip, heat from the heated element and pressure within the nip fuses the toner with substrate.

One type of fuser uses a heated roller, called fuser roller, and a nip-forming roller call a backup or pressure roller. Fuser rollers have been heated in different ways, including the use of an internal radiant heater, inductive heating, and by an internal resistive heating element. While fusers having a fuser roller and a backup roller have been very successful, they generally suffer from at least one significant problem: excessive warm-up time. When a typical prior art fuser roller using machine is initially turned on, or recovering from a "sleep" mode, it might take several minutes for the fuser roller to warm-up to a point at which fusing can be performed. Furthermore, to conserve energy and to prolong the life of various internal components it is beneficial to remove power from the fuser roller heater when the fuser roller is not being used. However, it could then take several more minutes to re-heat the fuser roller. These delays are highly objectionable.

The temperature of the fuser is critical. In order to provide a printer, such as a laser printer, that better accommodates a wide variety of print medium, lasers printers have been developed that allow a user to control the fuser temperature as a function of the print media type and other printer environmental conditions, such as ambient temperature and media moisture content. To provide quick response to fuser temperature change demand, the printer power supply must be capable of providing sufficient power when it is required.

The demands on a printer power supply are varied and heavy, especially at initially power-up. The fuser, for example, typically places a high demand, especially at initial power-up, on the power supply. Further, in some conventional printers, especially more complex, high end printers, instantaneous power consumption can suddenly jump to very high values with respect to the printer power supply output current rating. This situation would be exacerbated if fuser would also be energized during that same time interval. Therefore, the printer power supply output rating was required to be quite large as compared to its "normal" output loading during standard operating conditions of the printer. To reduce the cost of a printer, efforts have been made to reduce the size of the power supply by reducing peak power consumption.

Reducing peak power consumption in electrical systems has been practiced for many years with respect to industrial plants and commercial buildings. It is also known to purposefully control the initial energization of multiple printers and various electrical devices within a printers, such as paper-handling devices. For example, it is known to delay the initial energization of one or more printers, or of the fuser in one or more printers, in a group of multiple printers so as to not exceed the capacity of a circuit power source. It is also known to control the operation of printer paper-handling devices so as to prevent the energization of certain devices during the same time interval to reduce the peak power consumption being drawn from the printer power supply.

According there is a need for a printer that purposefully controls the energization of various electrical devices, both during initial power-up and normal operation of the printer, such that the printer power supply can provide sufficient power at all times to meet the demands of the fuser.

SUMMARY OF THE INVENTION

In a preferred embodiment, the present invention provides fuser power management logic that purposefully controls the energization of various electrically powered components in an electrophotographic imaging device, both during initial power-up and normal operation of the imaging device, thereby ensuring that sufficient power is available to the fuser to provide a quality image output and efficient operation of the imaging device.

A preferred embodiment of the present invention provides an electrophotographic imaging device includes a power supply providing electrical power to the electrically powered components of the imaging device and an image fixing device. A controller includes power management circuitry which manages the distribution of electrical power to the electrically powered components and to the image fixing device. The power management circuitry monitors both the total amount of electrical power provided by the power supply to the imaging device components and the electrical power provided to individual components. Whenever, due to print job requirements, for example, a requirement to provide additional electrical power to the image fixing device exists, the power management circuitry provides electrical power first from surplus electrical power where surplus electrical power is the difference between the capacity of the power supply and the total amount of electrical power being provided by the power supply. In the event insufficient surplus electrical power is available to meet the requirement for increased electrical power, the power management circuitry will provide electrical power secondly by selectively redirecting electrical power from one or more electrically powered components to the image fixing assembly.

In another preferred embodiment of the present invention, during an initial start-up phase or recovery from a standby or sleep mode of an electrophotographic imaging device, for example, the power management circuitry provides the maximum electrical power available to the image fixing device while delaying the application of electrical power to one or more of the remaining electrically powered components until the expiration of a predetermined time interval. Alternatively, the power management circuitry will provide the maximum amount of electrical power available to the image fixing device while delaying the application of electrical power to one or more of the remaining electrically powered components until the image fixing device has been heated to a desired operating temperature.

In a preferred embodiment, the present invention may be implemented as a method of managing the electrical power provided to an image fixing assembly utilizing the apparatus described above. The method preferably includes monitoring the total amount of electrical power provided by a power supply to electrically powered components of an electrophotographic imaging device, and providing additional electrical power to the image fixing assembly when a requirement for increased electrical power for the image fixing assembly exists, first from surplus electrical power where surplus electrical power is the difference between the capacity of the power supply and the total amount of electrical power being provided by the power supply.

Secondly, in the event insufficient surplus electrical power is available to meet the requirement for increased electrical power, selectively redirecting electrical power from one or more electrically powered components to the image fixing assembly.

Other embodiments and advantages of the present invention will be readily appreciated as the same become better understood by reference to the following detailed description, taken in conjunction with the accompanying drawings. The claims alone, not the preceding summary or the following detailed description, define the invention.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the following detailed description illustrate by way of example the principles of the present invention. The components in the drawings are not necessarily to scale, emphasis instead being placed upon clearly illustrating the principles of the present invention. In the drawings like reference numbers indicate identical or functionally similar elements throughout the several views thereof, and wherein.

DETAILED DESCRIPTION OF THE INVENTION

Figure 1:
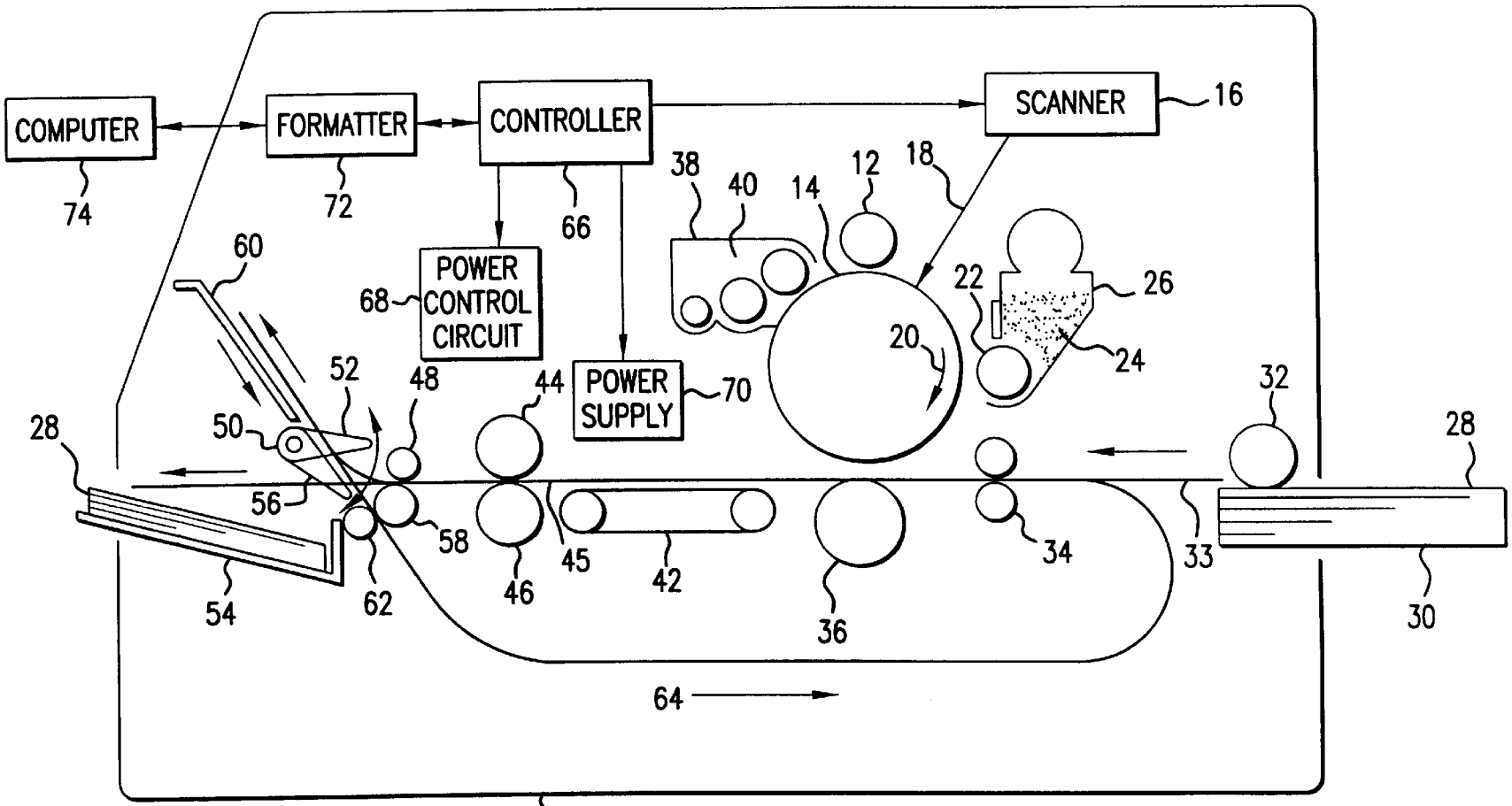
FIG. 1 illustrates a simplified schematic representation of an electrophotographic printer in which the present invention may be embodied.

As shown in the drawings for purposes of illustration, the present invention is preferably embodied in a fuser power controller which purposefully controls the energization of various electrical devices in an electrophotographic imaging device, both during initial power-up and normal operation of the imaging device, thereby ensuring that sufficient power is available to the fuser to provide a quality image output and efficient operation of the imaging device.

Referring now to FIG. 1, shown is a simplified cross sectional view of a electrophotographic imaging device 10, a laser printer, for example, in which the present may be embodied. It should be recognized that although the disclosed embodiment of the fuser power controller of the present invention is discussed in the context of a monochrome electrophotographic printer, it could also be used in other types of color or monochrome electrophotographic imaging devices, such as electrophotographic copiers or facsimile machines, for example. Furthermore, although preferred embodiments of the fuser power controller of the present invention will be discussed in the context of electrophotographic printer 10 which includes a single fuser or fixing device, the fuser power controller may also be put to beneficial use in electrophotographic imaging devices that employ two or more fusers.

A charging device, such as charge roller 12, is used to charge the surface of a photoconductor, such as photoconductor drum 14, to a predetermined voltage. A photoconductor exposure device, such as laser scanner 16, includes a laser diode (not shown) for emitting a laser beam. The laser beam 18 is pulsed on and off as it is swept across the surface of the photoconductor drum 14 to selectively discharge the surface of the photoconductor drum 14 forming a latent electrostatic image. Photoconductor drum 14 rotates in the clockwise direction as shown by the arrow 20. A developing device, such as developing roller 22, is used to develop the latent electrostatic image residing on the surface of photoconductor drum 14. Toner 24, which is stored in the toner reservoir 26, moves from locations within the toner reservoir 26, typically by gravity feed, to the developing roller 22. A magnet located within the developing roller 22 magnetically attracts toner 24 to and retains it on the surface of developing roller 22. As the developing roller 22 rotates in the counterclockwise direction, the toner 24 is transferred from the surface of the developing roller 22 to the selectively discharged areas of the surface of the photoconductor drum 14 to develop the latent electrostatic image formed thereon.

Media, such as print media 28, is withdrawn sheet by sheet from media tray 30 by pickup roller 32 and introduced into the media path 33 of the electrophotographic printer 10. Print media 28 is moved along the media path 33 by drive rollers 34. Print media 28 moves through the drive rollers 34 so that the arrival of the leading edge of print media 28 below photoconductor drum 14 is synchronized with the rotation of the region on the surface of photoconductor drum 14 having a latent electrostatic image corresponding to the leading edge of print media 28.

As the photoconductor drum 14 continues to rotate in the clockwise direction, the surface of the photoconductor drum 14, having toner adhered to it in the discharged areas, contacts print media 28 which has been charged by a transfer device, such as transfer roller 36, so that the print media 28 attracts particles of toner 24 away from the surface of the photoconductor drum 14 to the surface of print media 28. The transfer of particles of toner 24 from the surface of photoconductor drum 14 to the surface of print media 28 is not fully efficient and therefore some toner particles remain on the surface of the photoconductor drum 14. As photoconductor drum 14 continues to rotate, toner particles which remain adhered to its surface are removed by cleaning device 38 and deposited in toner waste hopper 40.

As print media 28 moves in the paper path past photoconductor drum 14, conveyer 42 delivers print media 28 to a fixing device, such as fuser 44. Fuser 44 may be an instant-on fuser that includes a resistive or inductive heating element located on a substrate or a halogen bulb fuser that includes a halogen filled bulb heating element disposed within a cylinder. As is known in the art, fuser 44 may operate at a single, fixed temperature or, alternatively, may operate at several selectable temperatures. Similarly, fuser 44 may be an assembly of two or more fusers, each fuser providing two or more selectable fuser temperatures/fusing speeds. For the purposes of the present disclosure, fuser 44 provides at least two selectable fusing temperatures, the fusing temperature selected being a function of several parameters including, for example, media type, media moisture content, printer environment temperature and humidity. Print media 28 is delivered to nip 45 formed by fuser 44 and pressure roller 46 and passes between fuser 44 and pressure roller 46. Pressure roller 46 is coupled to a gear train which, in turn is powered by one or more electrical motors (not shown). As pressure 46 rotates, print media 28 is pulled between fuser 44 and pressure roller 46, pressure roller 46 forcing print media 28 against the fuser 44. The heat and pressure applied to print media 28 fixes the toner 24 to the surface of print media 28. Exiting the fixing processing, the print media 28 continues along the media path passing between drivers 48 and 58.

Electrophotographic printer 10 includes the capability for duplex imaging. If, after an image is fixed on a first side of print media 28 by fuser 28, no image is to be fixed on a second side of print media 28, directional gate 50 is held in a first position 52. With direction gate 50 in the first position 52, print media 28 is directed into output tray 54. However, if an image is to be fixed on the second side of print media 28, directional gate 50 is held in a second position 56. In this case, drive rollers 48 and 58 will direct the print media 28 up and onto ramp 60. Then, after print media 28 clears the drive rollers 48 and 58, print media 28 will slide back into the nip area between drive rollers 58 and 62 and be directed along the media path in the direction indicated by arrow 64. With print media 28 moving in the direction indicated by arrow 28, the side of print media 28 opposite the side on which an image was previously fixed will be oriented to face the photoconductor drum 14 and the image forming process described above will be repeated to form the second image. At the completion of the fixing process for the second image, directional gate 50 is repositioned to the first position 52 and the print media 28 is directed to output tray 54 by drive rollers 48 and 58.

Thus, for duplex imaging, print media 28 will pass through the electrophotographic imaging process a second time. The moisture content of the print media is reduced as a result of the exposure to heat and pressure during the fixing process for the first image. The decrease in moisture content in the print media necessitates modifying several of the image development and fixing processes. For example, to ensure quality print output, it is necessary change the charging voltage applied to the transfer roller 36 and the bias current applied to fuser 44.

The electrophotographic imaging device 10 includes a controller 66 which controls the operation of the electrophotographic imaging device including providing electrical power to various components and controlling the data flow and imaging forming processes as discussed in more detail with reference to FIG. 2. Electrical power may be provided to the image fixing device, i.e., fuser 44, in a number of different manners depending on the type of fuser assembly, the type of heating means used and the particular imaging forming application. In a preferred embodiment, a adjustable bias current (or, alternatively, a bias voltage) is provided to the fuser 44 directly by a power supply 70 together with a variable power signal provided by a power control circuit 68. In one embodiment, power control circuit 68 adjusts the number of cycles of line voltage per unit time applied to fuser 44 to control the average power supplied to fuser 44. Controlling the average power supplied to the fuser 44 controls the operating of the fuser 44. The controller 66 controls both the power control circuit 68 and power supply 70 based on one or more parameters related to print media and print job characteristics to preserve image quality and ensure machine reliability and productivity. For example, the bias current provided to the fuser 44 by power supply 70 may be a function of the moisture content and resistivity of the print media while the average power provided by the power control circuit 68 may be a function of the print or toner density or the desired fusing speed.

Additionally, the electrophotographic imaging device 10 includes a formatter 72. Formatter 72 receives print data, such as display lists, vector graphics, or raster print data from one or more print drivers (not shown) operating in conjunction with an application program in host computer 74, for example. Formatter 72 converts these different types of print data to binary data representative of the received print data. Formatter 72 sends the print data binary stream to controller 66. In addition, the formatter 72 and controller 66 exchange other print job data necessary to control the electrophotographic imaging process, including information specifying whether a simplex or a duplex imaging operation is to be performed. In addition to controlling various components and assemblies, controller 66 also provides the print data binary stream to the laser scanner 16. The print data binary stream controls the exposure of photoconductor drum 14 by laser beam 18 to create the latent electrostatic image corresponding to the print data on the surface of the photoconductor drum 14.

Figure 2:
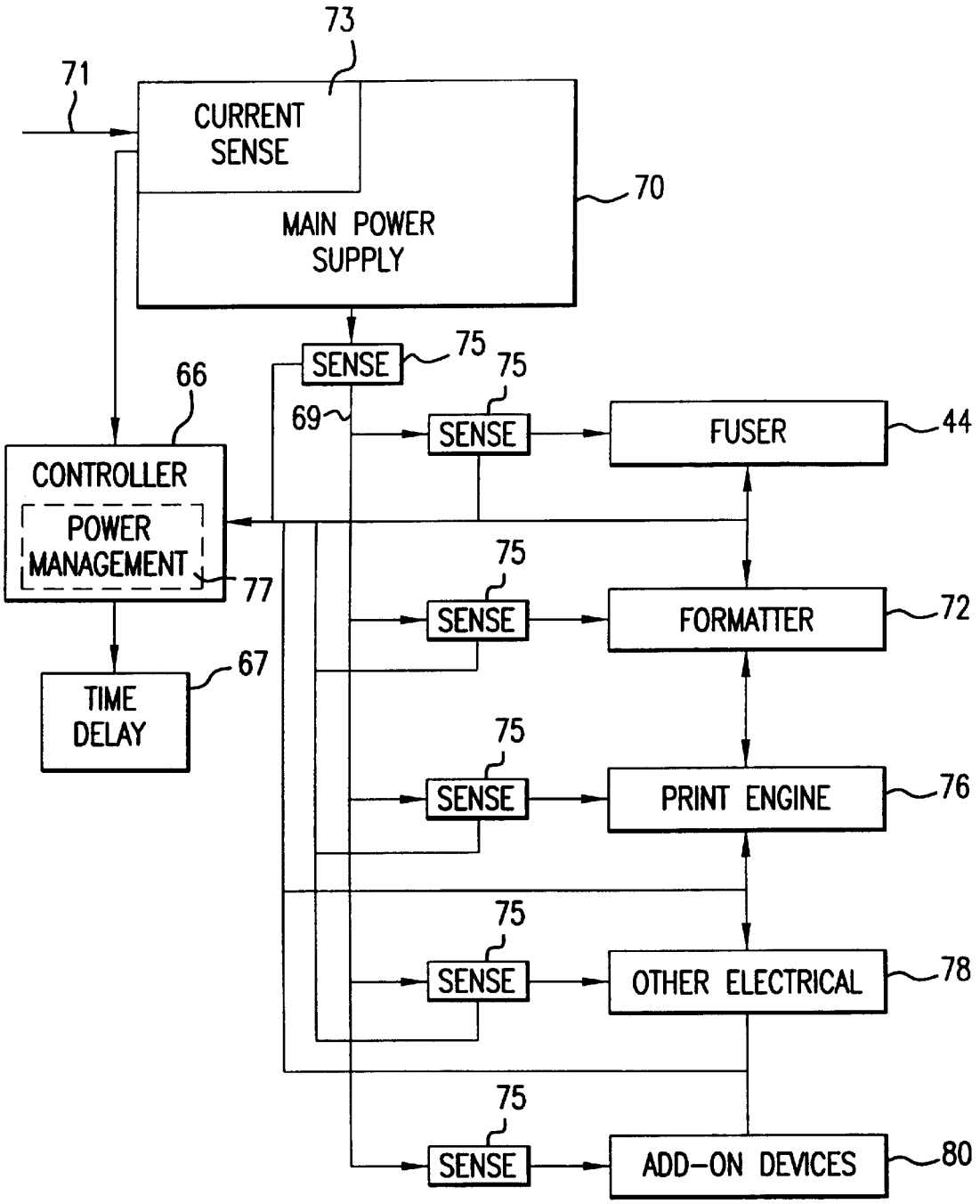
FIG. 2 illustrates simplified block diagram of the electrical system of an electrophotographic printer embodying the present invention.

Referring now also to FIG. 2, a simplified block diagram of the electrical system of an electrophotographic printer embodying the present invention is shown. As discussed above with reference to FIG. 1, the power supply 70 provides electrical power to all of the various subassemblies and other components of the imaging device 10. The power supply 70 provides one or more DC voltages to DC motors throughout the imaging device 10 and to the controller 66 and other low-voltage components. The power supply 70 also provides one or more AC voltages as well as line voltage as required by the various components of the imaging device 10. The power supply 70 receives its input power (line voltage) at input line 71 from a power source external to the imaging device 10. In the preferred embodiment, a current sensor 73 monitors the power supply input line 71 to determine the instantaneous power being used by the power supply 70. The current sensor 73 may be any of well-known power monitors which can measure instantaneous, average and total power usage.

As discussed above, power supply 70 provides electrical power via one or more power buses 69 to imaging device components including the fixing assembly or fuser 44, the formatter 72, the print engine 76, other electrical/electronic components 78 and add-on devices 80, for example. The print engine 76 typically may be the components utilized in forming the latent electrostatic image on the print media including the charge roller 12, the photoconductor drum 14, the laser scanner 16 (and laser), the developing roller 22, the toner reservoir 26, etc assembled in a replaceable module or cartridge. Other electrical/electronic components 78 include all the various electric motors and drive devices used in the imaging device to power gear trains, move the print media along the media path 33, power the pickup roller 32, etc., as well as the controller 66 and associated electronic control circuitry, printer displays (not shown) and user input devices. Add-on devices 80 generally include paper handling devices such as optional input trays, output paper stackers, staplers, collators and external duplexers, for example. While it is not uncommon for large, complex add-on paper handling devices, for example, to include a dedicated power supply, typically, the base imaging device power supply 70 will provide power to add-on devices 80.

The image fixing device, fuser 44, uses a significant amount of power, fusers using an inductive heating source in particular, to generate the fusing temperatures and heat required to provide optimal toner fixing to assure a quality printed image. Furthermore, for different types of print media, thinner or thicker media, for example, for different printing conditions or media characteristics, such as temperature, humidity or media moisture content, or for different demands on the imaging device itself, such as different printing speeds (pages per minute), print density, or resolution, for example, the fuser 44 power requirements will vary and may change from job to job, page to page within a print job, or even within a single page. In an electro-mechanical device such as electrophotographic imaging device 10, many of the components, such as DC motors, for example, as well as the fuser 44, require large amounts of power to operate, especially during a "start-up" or initial time interval. The amount of power available to operate the imaging device 10 is limited by the capacity of the power supply 70. In order to reduce costs and space requirements, typically, for most conventional imaging devices, the size and capacity of the power supply 70 is designed to be as small as possible and still be sufficient to provide all the power requirements of the imaging device 10. Often in view of these design requirements, the power supply 70, while able to provide sufficient power to handle normal operation, may not be able to adequately handle peak power loads. In order to accommodate the power requirements of the various imaging device components, the available power, limited by the capacity of the power supply 70, is budgeted (i.e., managed) such that each component is allotted an amount of power sufficient to handle normal operations of the component. Often, the amount of power budgeted for each imaging device component is fixed and may also be based on a basic imaging device as is shown in FIG. 1 and, thus, power may not be budgeted for add-on devices. A fixed power budget for each imaging device component may not allow sufficient flexibility to handle all varying and peak load conditions for a given component, and , further, in order to accommodate add-on devices not originally budgeted for, power may have to be diverted away from other imaging device components to handle additional add-on devices.

With continuing reference to FIG. 2, in a preferred embodiment according to the principles of the present invention, the power budget for the fuser 44 is flexible and is dynamically (i.e., in real time) managed as a function of the total power available to the imaging device 10 to meet the fuser 44 temperature and heat requirements for all types of print job conditions and requirements to ensure efficient and quality image output. According to one embodiment, controller 66 includes a power management function 77 which monitors via current sensor 73 the total power being used by the power supply 70 and, via sensors 75, the output of the power supply 70 and the power being used by each of the imaging device components 44, 72, 76, 78 and the add-on components 80. At any given instant, then, the total amount of power being provided by the power supply 70 and the amount of power being used by the imaging device components is known.

Controller 66 manages the power distribution first to provide the fuser 44 with sufficient power to meet the image fixing requirements, and second to meet the power requirements of the remaining imaging device components. For example, during normal operation of the imaging device 10, if the print media for a given print job is thicker than the print media for the previous job, more heat will be required to fix the toner with sufficient strength thus requiring a higher fuser 44 temperature to maintain the same printer speed (pages per minute) requiring more power for the fuser 44. In response, the controller 66 will direct additional power to the fuser 44 first from surplus available power (the capacity of power supply 70—instantaneous total power being used), and, second, from power made available by selectively redirecting power from other imaging device components. Thus, the controller 66 will reduce power to various components to ensure that sufficient power is available to meet the requirements of the fuser 44. The controller 66 will redirect power from those imaging device components which can be shut down or idled without compromising or degrading the operation of the imaging device 10 at that time. For example, most of the add-on components 80 are not required to be operating throughout the entire printing operation of the imaging device 10 and, therefore, may be selectively powered down or delayed for a short period of time without compromising the printing process. In one preferred embodiment, power reduction criteria and priorities are stored in a look-up table, accessed by the controller 66, to provide instructions to the power management function 77 for which components and in what order the power should be reduced and redirected to the fuser 44. Alternatively, in another preferred embodiment, controller 66 may include a microprocessor programmable by a user to provide the power reduction criteria and priorities via user input, such as by user input via a keyboard (not shown) at the host computer 74 (as shown in FIG. 1).

In another preferred embodiment, the controller 66 will delay providing electrical power to various high power demand components during initial power-up, or power-up from a standby condition, of the imaging device 10 until the fuser 44 has warmed up to its operating temperature. During warm-up, then, full power up to the AC line 71 input maximum is available to heat the fuser 44 to its operating temperature in the shortest possible time resulting in reduced time to first page out. Time delay circuitry 67 coupled to the controller 66 provides the appropriate time delays to be applied to the various imaging device components to ensure the shortest warm-up time for the fuser 44 and for the imaging device 10 overall. Alternatively, a temperature sensor (not shown) may be utilized to detect when the fuser 44 has reached its operating temperature and electrical power may be applied to the remainder of the imaging device 10 warm-up functions.

In addition to the foregoing, the power management logic 77 of the present invention can be implemented in hardware, software, firmware, or a combination thereof. In the preferred embodiment(s), the power management logic 77 is implemented in software or firmware that is stored in a memory and that is executed by a suitable instruction execution system. If implemented in hardware, as in an alternative embodiment, the power management logic 77 can be implemented with any or a combination of the following technologies, which are all well known in the art: a discrete logic circuit(s) having logic gates for implementing logic functions upon data signals, an application specific integrated circuit (ASIC) having appropriate logic gates, a programmable gate arrays(s) (PGA), a field programmable gate array (FPGA), etc. For example, in a preferred embodiment, controller 66 may include a microprocessor executing a set of instructions implementing the power management function 77.

While having described and illustrated the principles of the present invention with reference to various preferred embodiments and alternatives, it will be apparent to those familiar with the art that the invention can be further modified in arrangement and detail without departing from those principles. For example, the present invention may be embodied in a power controller adapted to control the application of electrical to various electrically-powered components in a multi-function peripheral to provide priority heating and warmup for a scanner as well as for the printer fuser. Accordingly, it is understood that the present invention includes all such modifications that come within the terms of the following claims and equivalents thereof.

What is claimed is:

1. In an electrophotographic imaging device including a power supply and an image fixing assembly, a method of managing the electrical power provided to the image fixing assembly, comprising the steps of:

monitoring a total amount of electrical power provided by the power supply having a fixed capacity to components of the electrophotographic imaging device;

providing additional electrical power to the image fixing assembly in response to a requirement for increased electrical power for the image fixing assembly from surplus electrical power where surplus electrical power is the difference between the fixed capacity of the power supply and the total amount of electrical power being provided by the power supply; and in the event insufficient surplus electrical power is available to meet the requirement for increased electrical power, selectively redirecting electrical power from one or more components to the image fixing assembly.

2. The method of claim 1 wherein the step of monitoring the total amount of electrical power provided by the power supply includes the further step of monitoring the amount of electrical power provided by the power supply to selected components of the electrophotographic imaging device.

3. The method of claim 1 during an initial start-up phase of the electrophotographic imaging device including the further steps of:

providing a maximum amount of electrical power to the image fixing assembly; and delaying the application of electrical power to one or more components until the expiration of a predetermined time interval.

4. The method of claim 1 during an initial start-up phase of the electrophotographic imaging device including the further steps of:

providing a maximum amount of electrical power to the image fixing assembly; and delaying the application of electrical power to one or more components until the image fixing assembly has been heated to an operating temperature.

5. The method of claim 1 wherein the step of selectively redirecting electrical power from one or more components to the image fixing assembly includes the step of selecting the one or more components based on predetermined criteria and priorities.

6. An electrophotographic imaging device comprising:

a power supply in communication with a plurality of electrically powered components;

an image fixing device; and a controller including power management circuitry adapted to manage the distribution of electrical power to the plurality of electrically powered components and the image fixing device, the power management circuitry being further adapted to:

monitor a total amount of electrical power provided by the power supply;

provide additional electrical power to the image fixing device in response to a requirement for increased electrical power for the image fixing device from surplus electrical power where surplus electrical power is the difference between a fixed capacity of the power supply and the total amount of electrical power being provided by the power supply; and in the event insufficient surplus electrical power is available to meet the requirement for increased electrical power, selectively redirect electrical power from one or more electrically powered components to the image fixing device.

7. The electrophotographic imaging device as in claim 6 wherein the electrophotographic imaging device comprises a laser printer.

8. The electrophotographic imaging device as in claim 6 further comprising one or more sensors for monitoring the amount of electrical power provided by the power supply to selected electrically powered components of the electrophotographic imaging device.

9. The electrophotographic imaging device as in claim 6 further comprising time delay means for delaying the application of electrical power to one or more electrically powered components until the expiration of a predetermined time interval.

10. The electrophotographic imaging device as in claim 9 wherein the power management circuitry is further adapted to provide a maximum amount of electrical power to the image fixing device during an initial start-up phase or recovery from a standby mode of the electrophotographic imaging device, and delay the application of electrical power to one or more of the remaining electrically powered components until the expiration of the predetermined time interval.

11. The electrophotographic imaging device as in claim 6 wherein the power management circuitry is further adapted to provide a maximum amount of electrical power to the image fixing device during an initial start-up phase or recovery from a standby mode of the electrophotographic imaging device, and delay the application of electrical power to one or more of the remaining electrically powered components until the image fixing device has been heated to a desired operating temperature.

12. The electrophotographic imaging device as in claim 6 wherein the power management circuitry is further adapted to selectively redirect electrical power from one or more electrically powered components to the image fixing device based on predetermined criteria and priorities.

13. The electrophotographic imaging device as in claim 12 further comprising memory means accessible by the power management circuitry for storing a set of predetermined criteria and priorities for selectively redirecting electrical power from one or more electrically powered components to the image fixing device.

14. The electrophotographic imaging device as in claim 6 wherein the power management circuitry includes power management logic adapted for purposefully controlling the energization of one or more of the plurality of electrically powered components in the electrophotographic imaging device, both during initial power up and normal operation of the electrophotographic imaging device, to ensure sufficient power is available to the image fixing device to meet power demands of the image fixing device.

* * * * *